United States Patent [19]

Miskin

[11] 4,398,363

[45] * Aug. 16, 1983

[54] EARTH MOVING SCRAPER

[76] Inventor: Richard B. Miskin, P.O. Box 218, Ucon, Id. 83454

[ * ] Notice: The portion of the term of this patent subsequent to May 17, 2000, has been disclaimed.

[21] Appl. No.: 307,491

[22] Filed: Oct. 1, 1981

[51] Int. Cl.[3] ..... E02F 3/00

[52] U.S. Cl. ..... 37/129; 37/126 AA; 37/126 AC

[58] Field of Search ..... 37/124 R, 126 R, 126 A, 37/126 AA, 126 AB, 126 AC, 126 AD, 126 AE, 127, 128, 129, 8

[56] References Cited

U.S. PATENT DOCUMENTS

| | | | |
|---|---|---|---|
| 2,181,760 | 11/1939 | Le Bleu | 37/126 AC |
| 2,227,433 | 1/1941 | Berner | 37/126 AA |
| 2,250,289 | 7/1941 | Barrett | 37/126 AC |
| 2,278,329 | 3/1942 | McCollum | 37/126 AB |
| 2,994,975 | 8/1961 | Schumaker et al. | 37/126 AA |
| 3,643,355 | 2/1972 | Eiger | 37/126 X |
| 3,651,589 | 3/1972 | Reynolds | 37/126 AA |

*Primary Examiner*—E. H. Eickholt

*Attorney, Agent, or Firm*—Terry M. Crellin; B. Deon Criddle

[57] ABSTRACT

Earth moving, ground leveling and land planing apparatus having a substantially rectangular frame which is pivotally attached at the back end thereof to a support member containing ground engaging wheels. A cutting blade is disposed laterally between the bottom sides of the frame and a bucket having an open front end is pivotally mounted at its lower forward edge to the frame adjacent the blade for swinging between a generally horizontal earth loading position and an upwardly tilting unloading position. An apron comprising a swingable gate is provided to form an operable front wall for the bucket. Means are provided for swinging the apron about a pivot axis which is transverse of the frame, at a vertical distance above the bottom of the frame equal to at least about one-half the vertical depth of the bucket and displaced forward of the blade.

5 Claims, 16 Drawing Figures

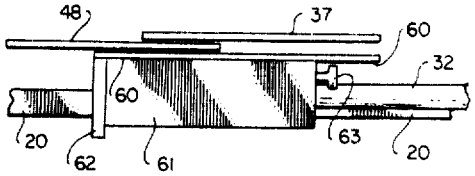
Fig. IA
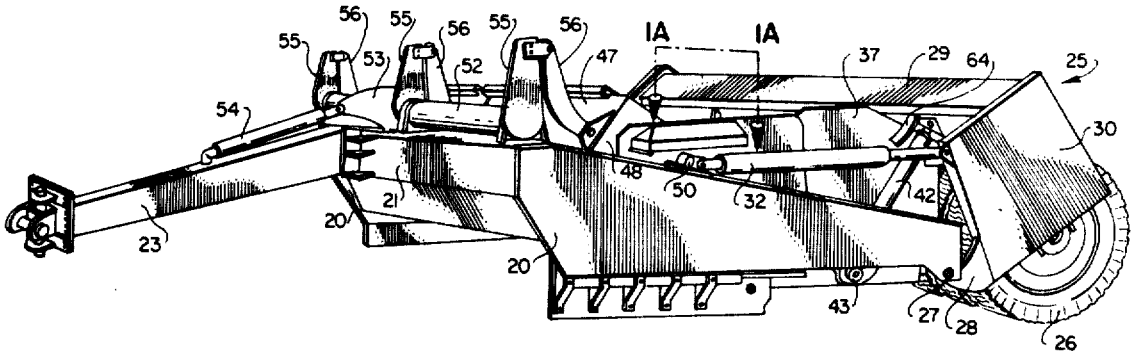
Fig. I
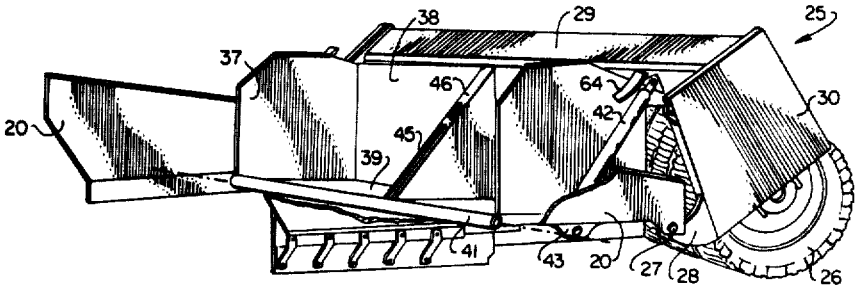
Fig. 2
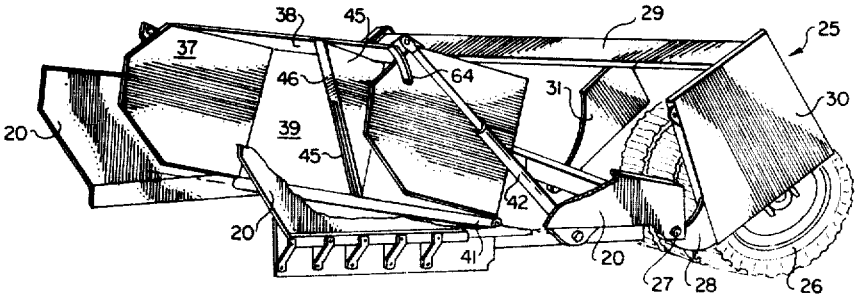
Fig. 3

5A
5B

EARTH MOVING SCRAPER

BACKGROUND OF THE INVENTION

1. Field

The invention relates to apparatus for leveling ground, land planing and earth moving. In particular, the invention relates to earth moving scrapers of the type having a cutting blade carried by a frame, with a bucket mounted behind the blade to receive and carry soil severed from the terrain by the blade.

2. State of the Art

Scrapers and earth moving apparatus of the general type to which the present invention pertains are known in the art. See, for example, U.S. Pat. Nos. 2,159,045; 2,411,688; 2,445,26; 2,993,284; 3,049,819; 3,110,972; 3,154,868; 3,651,589; and additional references cited therein.

In the typical scraper apparatus as disclosed in the abovementioned patents, the bucket, having a bottom floor, upstanding end and back walls and an open front is supported on the frame for swinging between a generally horizontal position for loading of soil therein to an upwardly tilted position for dumping soil therefrom. The cutting blade of the apparatus is attached to the lower front edge of the open front of the bucket so that the blade moves with the bucket when the bucket is swung between its loading and dumping positions. The blade is mounted on the bucket so that when the bucket is in its loading position, the blade is disposed with its cutting edge beneath the bottom of the frame and bucket, with the bucket being positioned behind the blade to receive soil cut from the terrain by the blade as the apparatus is moved forwardly over the terrain. A vertically movable gate or apron forms an operable front wall for the bucket. When the bucket is loaded to the desired extent, the bucket with the blade is raised above the surface of the terrain, and the open front of the bucket is at least partially closed by lowering the gate or apron into its lowered position so as to retain the load within the bucket during transport. In unloading the bucket, the gate or apron is moved upwardly and the bucket is swung into the dumping position for the load to be dumped from the open front of the bucket under the influence of gravity.

In the scraper apparatus disclosed in U.S. Pat. No. 3,651,589 the frame on which the bucket and cutting blade are attached is hingedly connected at the back end of the frame to a support member containing ground engaging wheels, whereby the frame and the support member can pivot relative to each other about a pivot axis transverse to the back end of the frame and forward of the wheels on the support member. A hydraulic actuator is pivotally attached at its respective ends to the frame and the support member. The hydraulic actuator is adapted to control pivoting of the frame relative to the support member so as to raise or lower the frame relative to the terrain.

Typically, the movable gate or apron is adapted to move in a substantially planar, up and down movement or swing in an arc in which the pivot axis for the gate or apron is located in the same vertical plane or in back of the vertical plane through the cutting blade. Those which move in a planar up and down movement simply form a raisable front wall for the bucket and in no way increase the load carrying capacity of the bucket. Those which swing in an arc may have end walls which extend back therefrom into the open front of the bucket, thereby increasing the effective load carrying capacity of the bucket. However, the arc swing of the apron simply cuts through the load and does not tend to reach out and scoop additional dirt into the load in the bucket as the apron closes.

Objectives

A principal objective of the present invention is to provide an apron which reaches out and scoops dirt into the bucket, pushing additional load into the bucket as the apron swings downwardly or closes. An additional objective is to provide an apron having end walls which extend back parallel and closely spaced from the outer faces of the side walls of the bucket to interleaf between the sidewalls of the bucket and stationary guard plates extending from the frame, whereby the combination prevents spillage of dirt from the side ends of the bucket as the bucket and apron move between their various operable positions and, in addition, minimizes the possibility of dirt and rocks from accumulating in openings or spaces between the bucket and apron which would otherwise interfere with the proper operation of the bucket and apron also avoiding interference between bucket and apron because of their shapes when they are both in maximum dumping position.

SUMMARY OF THE INVENTION

In accordance with the present invention, an improvement is provided in earth moving, ground leveling and land planing apparatus of the type comprising a frame supported by at least two ground engaging wheels at the back end of the frame; a cutting blade disposed laterally between the opposite longitudinal sides of the frame and adjacent to the bottom of the frame; a bucket having an open front end, with the bucket being pivotally mounted at its lower forward edge to the frame adjacent to the trailing edge of the cutting blade for pivotal movement from a lowered carrying position to an elevated dumping position; and a vertically movable apron forming an operable front wall for the bucket. The improvement comprises an apron which is designed to scoop and push dirt into the effective load carrying confines of the bucket and apron.

Means are provided for swinging the apron about a pivot axis which is transverse of the frame of the apparatus. The pivot axis is located at a vertical distance above the bottom of the frame equal to at least one-half the vertical depth of the bucket. Further, the pivot axis is displaced slightly forward of the cutting edge of the blade. The upstanding transverse wall of the apron is preferably generally concaved in a vertical cross section so as to strengthen the wall and to aid the lower edge of the apron to cut through the dirt as the apron pivots from its open elevated position to its closed, lowered position.

The apron further has end walls which extend back parallel and closely spaced from the outer faces of the side walls of the bucket, whereby the end walls of the apron and the side walls of the bucket can move in their respective planes relative to each other in interleaf type fashion. With the end walls of the apron being closely spaced from the outer faces of the side walls of the bucket, the dirt being cut by the blade at the sides of the bucket contacts the inside face of the bucket and minimizes the possibility of dirt and rocks getting caught in the space between the end walls of the apron and the side walls of the bucket. When the apron closes the end walls thereof do not contact the dirt in the bucket and thus there is no forcing of dirt and rocks between the face to face walls of the bucket and apron which could seriously interfere with the operation of the bucket and apron. The positioning of the end walls of the apron outside the side walls of the bucket also avoids interference between the bucket and apron because of their shapes when the apron is in its open position and the bucket is in its dump position.

A stationary guard plate is preferably positioned upstanding from the frame so that the guard plate is spaced face to face with the outer faces of the end walls of the apron so that the apron moves in interleaf type fashion between the side walls of the bucket and the guard plate. The guard plate prevents dirt from falling from the sides of the load when the upper rear portions of end walls of the apron swings downwardly as the apron opens.

Additional objects and features of the invention will become apparent from the following detailed description taken together with the accompanying drawings.

THE DRAWINGS

A preferred embodiment of the invention representing the best mode presently contemplated of carrying out the invention is illustrated in the accompanying drawings in which:

FIG. 1 is a pictorial view of the apparatus in accordance with the invention;

FIG. 1A is a partial plan view taken along line 1A—1A of FIG. 1.

FIG. 2 is view similar to that of FIG. 1 with the forward and side of the apparatus broken away to show the load carrying bucket in its lowered, load carrying position;

FIG. 3 is a view similar to that of FIG. 2, showing the bucket in its forwardly pivoted dumping position;

DETAILED DESCRIPTION OF THE ILLUSTRATED EMBODIMENT

Figure 4:
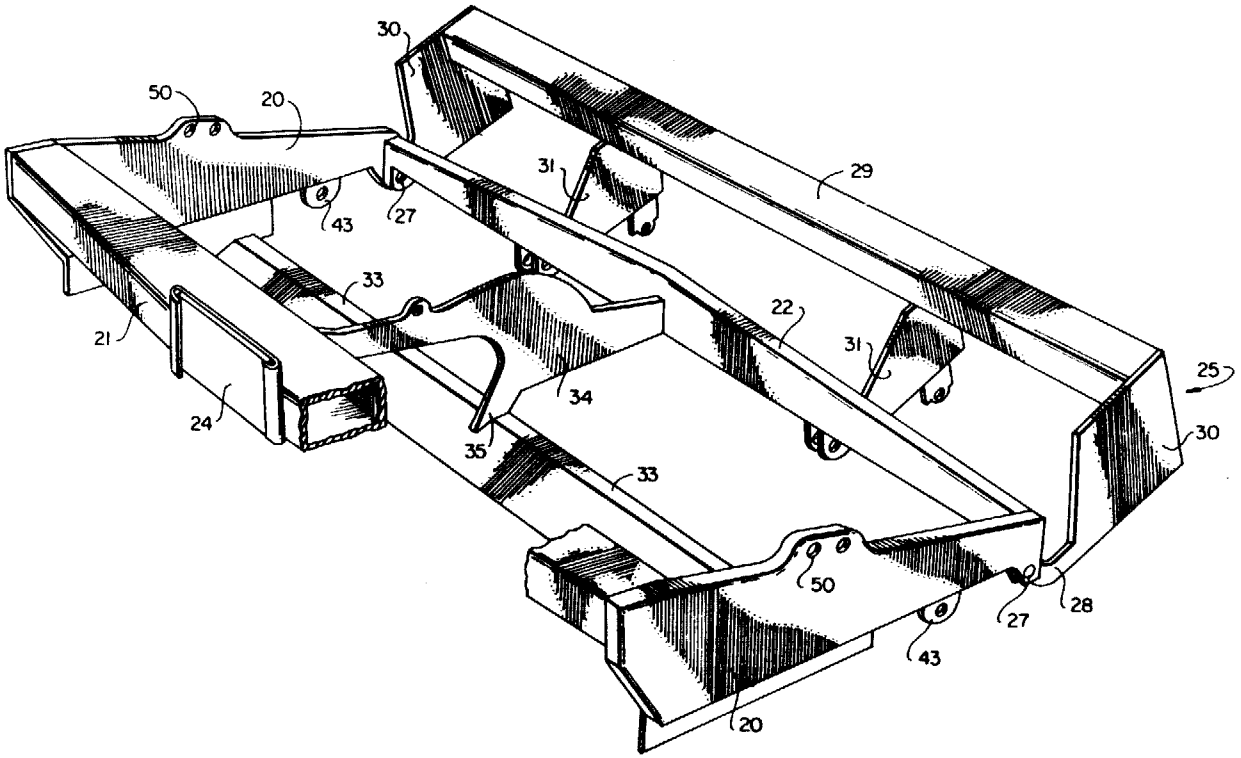
FIG. 4 is a pictorial view of the frame and carriage support at the back of the frame which is adapted to contain ground engaging wheels upon which the apparatus is carried.

Referring to the drawings, the earth-moving, ground leveling and land planing apparatus or machine of the present invention comprises an open rectangular frame having longitudinally extending side members 20 and laterally extending front end member 21 and rear end member 22. A tongue 23 extends forwardly from a mounting plate 24 on the central portion of the front end member 21. A novel hitch means as will be described hereinafter is provided for connecting the machine or apparatus to a tractor or other suitable motive vehicle for pulling the scraper apparatus over the surface of the terrain.

Each of the side frame members 20 is pivotally connected to a support member or carriage 25 containing ground engaging wheels 26. Although wheels 26 are shown in the drawings only on one side of the carriage 25, a similar set of wheels are provided at the other side of the carriage 25. As illustrated, the back ends of the side frame members 20 are pivotally attached through respective pivot hinges 27 to bell cranks 28 extending forwardly of the carriage 25 and the support wheels 26 therefore. The carriage 25 comprises a cross beam 29 to which end plates 30 are attached. The bell cranks 28 extend from the end plates 30. A pair of plates 31 are spaced respectively from the end plates 30 to the cross beam 29, extending downwardly from the cross beam 29. The plates 31 are adapted to receive respective axles (not shown) extending inwardly from the end plates 30, and the wheels 26 are mounted on such axles. The axles upon which the wheels 26 are mounted are, thus, seen to be parallel to the back end 22 of the frame, so that the apparatus is adapted to be pulled forward by a motive vehicle while attached to the tongue 23 of the apparatus.

As can be seen, the frame and the support member or carriage can pivot relative to each other about a pivot axis transverse to the frame at the back end 22 of the frame and forward of the wheels 26 on the carriage. An actuator in the form of a hydraulic cylinder or ram 32 is provided at each side of the apparatus. Each actuator or ram 32 is pivotally attached at one of its ends to the upper portion of the respective side frame members 20, with the other end of such ram 32 being attached to a portion of a respective end plate 30 on the carriage. The pivotal connection of the ram 32 to the plate 30 of the carriage is above the axis through the wheels 26 of the carriage. As the rams 32 (one on each side of the apparatus) are shortened, the pivot hinges 27 between the frame and the carriage is rotated downwardly so as to move the frame generally horizontally toward the ground over which the apparatus is being pulled. Conversely, when the rams 32 are lengthened, the pivot hinges 27 rotate upwardly and the frame is lifted upwardly from the ground.

A cutting blade 33 (FIGS. 4, 5, 5A, 6, 11, 12) spans the frame transversely from one side frame member 20 to the other. The blade 33 is firmly attached at its ends to the respective side frame member 20. As shown, the blade 33 is displaced backward from the front end of the frame nearly intermediate between the front and back ends of the side frame members 20. The actual position of the blade relative to the front and back of the frame is not critical per se. What is required, of course, is that sufficient portion of the frame be allowed behind the cutting blade to accommodate a bucket as described hereinafter and that sufficient space be provided ahead of the blade 33 to accommodate an apron as to also be described hereinafter. Normally, the blade 33 will be located somewhere near the midsection of the frame. As shown in the drawings, the cutting blade 33 is positioned adjacent to the bottom surface of the frame and slants downwardly at a small angle so that the leading, cutting edge of the blade 33 is disposed below the bottom of the frame to penetrate the soil when the frame is lowered sufficiently toward the ground. The depth that the blade cuts into the ground is, of course, determined by raising and lowering of the frame with respect to the ground.

For land planing applications in particular, as well as in ground leveling applications, it is advantageous to utilize a wide cut, and the cutting blade 33 is then at least about 10 feet and preferably 14 to 18 feet or more in length along its cutting width. Inasmuch as the blade 33 is supported at its ends to the side frame members 20 and spans the cutting distance across the frame, the blade is, especially when the blades span about 10 feet or more, susceptible to undesirable deflection from the weight of the load accumulated over the blade in the bucket as well as from forces exerted on the blade by the ground as the blade cuts through the ground. Rather than rely on sole support of the blade by the bucket, i.e., by attaching the blade to the front edge of the floor of the bucket or hinging the blade in a piano hinge fashion to the front edge of the floor of the bucket as has been done in the prior art, the blade 33 of the present invention is supported at a point substantially intermediate its cutting width by a novel, unique blade support system.

A blade support member 34 in the form of a heavy, generally elongate plate extends from the back end member 22 of the frame to the forward end member 21 of the frame. The support member 34 is firmly attached to the front and back end members 21 and 22 of the frame such as by welding. The support member 34 is positioned so that it extends substantially along the longitudinal center of the frame. The support member 34 has a downwardly extending portion, shown in the drawings as a downwardly extending projection 35, which is integrally attached such as by welding to the blade 33 at a point substantially intermediate the cutting width of the blade 33. The support member 34 ties the intermediate portion of the blade 33 into the forward and rear ends 21 and 22 of the frame so as to strengthen the blade 33 and to eliminate unwanted deflection of the blade 33. Although not shown in the drawings, and as mentioned above, the blade 33 can be constructed as well known in the art so as to have a leading cutting edge portion which is removable from the body of the blade, whereby the cutting edge portion can be removed to be sharpened or for other maintenance. If the blade 33 does have such a removable cutting edge portion, the portion 35 of the support member 34 which is attached to the blade 33 is attached to the body portion of the blade such that the cutting edge portion can be removed without requiring the separation of the blade support member 34 and the body portion of the blade 33.

The support given to the blade 33 by the central support member 34 is very important in obtaining good leveling and planing of the land as is becoming required by the users of such machinery. This is especially so when land planing using the so called "laser" system is being accomplished by the machinery. In "laser" planing, a circulating light beam is projected out from a central point, and a receiver is included on the planing equipment. The equipment is adapted to raise and lower the cutting blade of the apparatus in accordance with the light beam. Heretofore, the light beam receiving member has been mounted to the frame of the land cutting and planing apparatus. As weight of the lead builds on the blade, the blade deflects downwardly, but the light detection or receiving member has no way to counteract such change in the cutting or planing of the ground. In accordance with the present invention, the deflection of the blade is minimized. Additionally, the light receiving member of the "laser" system can be mounted directly to the central support member 34 which, of course, is affixed directly to the central portion of the blade. Thus, the light detecting system controls directly the relative height of the cutting blade with respect to the light beam.

A bucket for receiving dirt severed from the terrain by the blade 33 is positioned directly behind the blade 33. The bucket has side walls 37, a rear wall 38, and a bottom floor 39. The bucket is disposed with the forward edge of the bottom floor 39 thereof immediately behind and adjacent to the trailing edge of the blade 33. The bucket is swingably supported from the side members 20 of the frame by means of pins which extend outwardly from the opposite forward corners of the floor 39 of the bucket for mounting within pivot bearings (not shown) in the side members 20 of the frame. Alternatively, as shown in FIGS. 2 and 3, a cylindrical piano type hinge 41 connects the forward edge of the floor 39 of the bucket to the trailing portion of the blade 33, with a pivot pin (not shown) extending through the hinge 41 from the side members 20 of the frame. In either situation the bucket is adapted to pivot about the pivot axis through the forward edge of the floor 39 of the bucket, from a lowered carrying position as shown in FIG. 2 wherein the floor 39 of the bucket is substantially parallel to the bottom of the frame to an elevated dumping position in which the floor 39 is in a forwardly tilted position and vice versa.

Actuator means in the form of double acting hydraulic rams are provided for moving the bucket in its tilting movement. A pair of hydraulic rams 42 are pivotally attached at mutually respective ends to the respective side frame members 20 near the bottom of the frame. As illustrated, the rams 42 are pivotally attached to pivot blocks 43 which are attached to the side frame members 20 of the frame at a point along the side frame members 20 substantially beneath the midpoint of the floor 39 of the bucket when the bucket is in the retracted carrying position. The other respective ends of the rams 42 are pivotally connected to the bucket near the respective back upper edge corners thereof. When the rams 42 are retracted, the bucket moves to its retracted carrying position as shown in FIGS. 1, 2, 5, 6, 7 and 8. When the rams 42 are extended, they push the bucket upwardly and forwardly into its elevated dumping position as shown in FIG. 3.

The positioning of the rams 42 has been found to be of great importance. By connecting the upper ends of the rams 42 to the upper back corners of the bucket, with the lower ends of the rams 42 being connected to the frame side members 20 beneath the bucket and between the lateral midpoint and the back edge of the floor 39 of the bucket when the bucket is in its retracted carrying position, optimum operational characteristics of the rams 42 are utilized and stress on the pivot mechanism for the bucket is minimized. With the rams 42 located in accordance with the invention, maximum upward lifting forces are exerted on the bucket to lift the heavy load carried thereby, with minimal horizontal shear forces being exerted in the pivot hinge mechanism. Further, the rams 42 are of optimum size with respect to the diameter of the cylinder in the ram as well as to the extensible length of the ram. If the actuating ram is positioned horizontally, as is customary in the art, larger forces are applied to the bucket pivot mechanism resulting in a larger mechanism to counteract stress and wear. The larger pivoting mechanism then impeads the loading and unloading of the bucket. Further, the possible decrease in cylinder diameter of the ram due to the increased torque is greatly offset by the large increase in effective operating length of the ram which is needed to pivot the bucket to its full forward tilted position. Positioning of the rams 42 in accordance with the present invention achieves an absolute minimum operating length of the rams while simultaneously producing maximum efficiency in lifting and pivoting the bucket with minimal wear of the pivot mechanism. In accordance with the invention, it has been found that while it is most preferable to connect the lower ends of the rams 42 to the frame side members 20 at a point substantially midway between the forward and rear edges of the floor 39 of the bucket when the bucket is in its retracted, load carrying position, the lower ends of the ram 42 can be connected to the side frame members 20 anywhere along the side frame members 20 which is between about the midpoint and the back edge of the floor 39 of the bucket. As the point of connection moves backward on the frame towards the back edge of the floor 39 of the bucket, more direct initial uplift force is exerted on the bucket, but the working length of the ram increases. As noted above, the optimum position for connection of the rams is at a point midway between the forward and back edge of the bucket when the bucket is in its retracted position.

Figures 5, 5A, 5B, 5C:
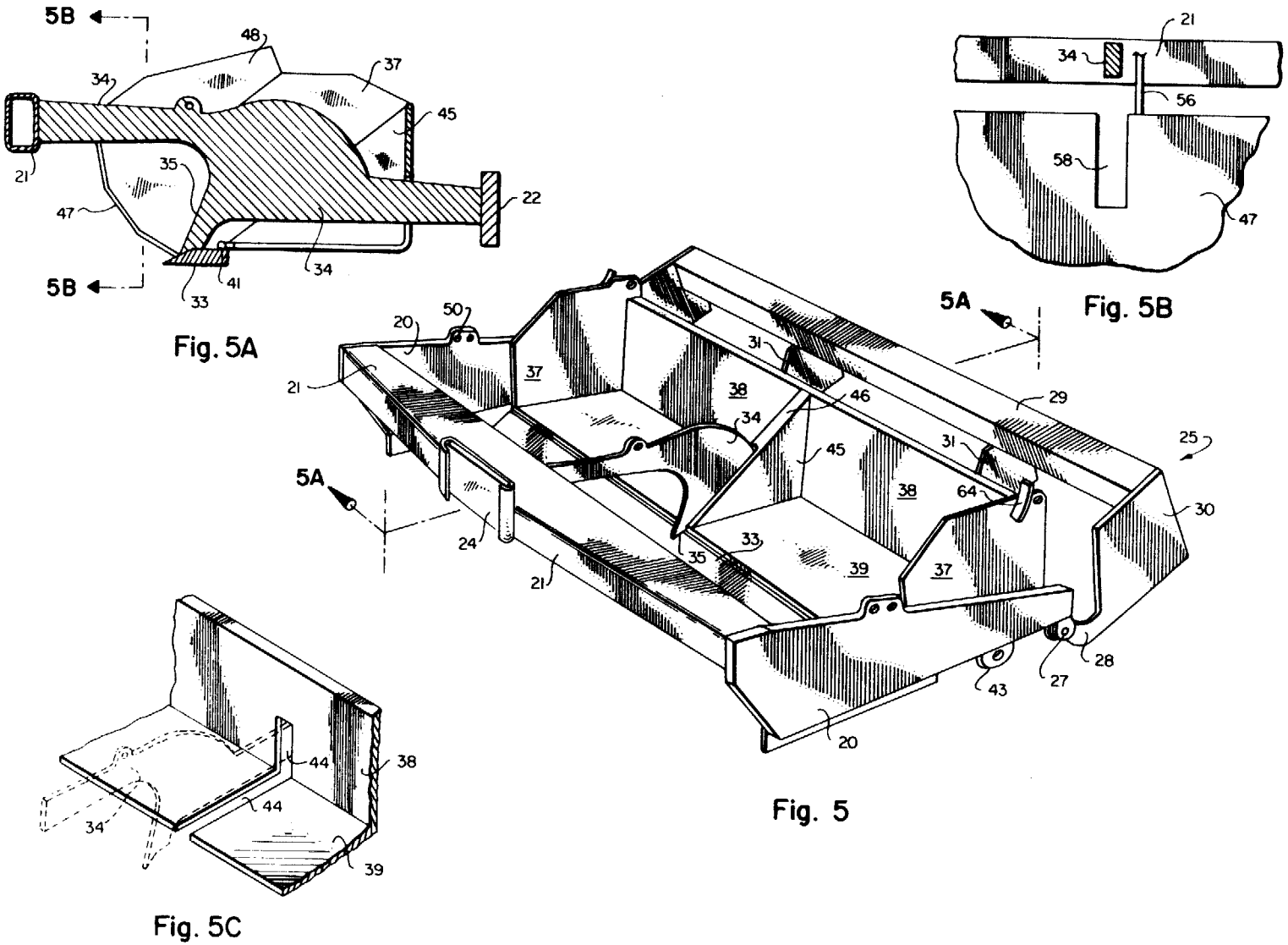
FIG. 5 is a view similar to that of FIG. 4 showing the bucket in its lowered, load carrying position within the frame.
FIG. 5A is a cross-sectional view taken along line 5A—5A of FIG. 5 with the apron being added and shown in its closed position.
FIG. 5B is a partial cross sectional view taken along line 5B—5B of FIG. 5.
FIG. 5C is a partial pictorial of the central portion of the bucket with the gusset plates as shown in FIG. 5 removed and with the blade support member shown in phantom.

Means are provided to accommodate the swinging, tilting motion of the bucket relative to the blade support member 34. As best illustrated in FIGS. 5A and 5C, an elongate slot 44 having a width sufficient to receive the blade support member 34 for sliding motion therein extends from the forward edge of the floor 39 of the bucket to the back edge of the floor 39. The slot 44 continues no more than about half way upward in the back wall 38 of the bucket. The support member 34 is shown in phantom in FIG. 5C, and it can be seen that when the bucket tilts forwardly, the relative movement between the floor 39 and back wall 38 of the bucket is accommodated by the relative sliding motion of the blade support member 34 within the slot 44.

To provide strength to the portion of the bucket containing the slot 44, a pair of gusset plates 45 are welded to the floor 39 of the bucket so as to extend substantially upwardly from the respective longitudinal edges of the slot 44 in the floor of the bucket. The gusset plates 45 also extend upwardly along the back wall 38 of the bucket so that the blade support member 34 is received within the space between the pair of gusset plates 45. Preferably, the support member 34 has a substantially circular upper edge periphery in the vicinity where the triangular shaped gusset plates 45 move when the bucket is tilted to its forward position. The radius of the circular portion of the support member is centered at the bucket hinge point 41. The upper portion of the space between the forward edges of the triangular gusset plates 45 may have a cap plate 46 welded thereto to close the opening therebetween and add strength to the gusset plates 45. In addition to strengthening the bucket, the gusset plates 45 and the cap plate 46 prevent dirt and rocks from accumulating and jamming in the slot 44 in the bucket. The forward edges of the gusset plates 45 located adjacent to the side faces respectively of the blade support member 34 act as scrapers when the bucket is tilted forward to cut through and dislodge any accumulation of dirt which may adhere on the sides of the blade support member 34 as the bucket is being filled with dirt and preceding dumping of the dirt from the bucket. The lower edge of the cap member 46 is positioned closely adjacent to the circular upper edge of the support member 34 so that as the bucket rotates a very close gap is maintained between the upper edge of the support member 34 and the lower edge of the cap member. This prevents dirt or rocks from lodging in the gap between the gusset plates 45 and ultimately into the slot 44 in the bucket.

A vertically moving apron or gate 47 is provided near the front end of the frame. The apron 47 forms an operable front wall for the bucket. The apron 47 comprises a substantially upstanding wall portion which extends laterally between the side frame members 22 of the frame. The apron 47 has end walls 48 which extend back parallel and spaced slightly from the outer faces of the side walls 37 of the bucket.

Figure 8:
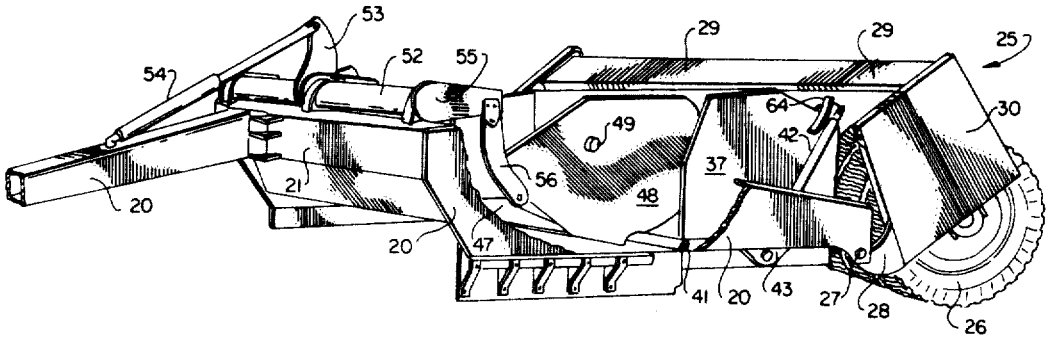
FIG. 8 is a view similar to that of FIG. 7 showing the apron in its closed lowered postion.

Means are provided for swinging the apron about a pivot axis which is transverse of the frame. As illustrated, pivot pins 49 extend outwardly from the end walls 48 of the apron. The pivot pins 49 engage journal bearings 50 in the respective sides of the side frame members 20. As illustrated, the journal bearings 50 are contained in a bearing block which is attached to the upper side of the frame members 20. However, the journal bearings could just as well be positioned in the inside side faces of the side frame members 20. The pivot pins 49 are located such that when the apron 47 is in its closed position as shown in FIGS. 5A and 8, the horizontal distance from the pivot pin 49 to the top edge of the lateral wall of the apron 47 is less than the distance from the pivot pin 49 to the downward edge of the lateral wall portion. The lateral wall portion of the apron 47 is also generally concave in shape for strengthening the wall and for aiding the leading downward edge thereof to cut through the dirt as the apron is lowered into its closed position. Because of the upper edge of the wall of the apron 47 is closer to the pivot point of the apron than is the downward edge, the upper edge of the apron moves within the loci of the arc determined by the movement of the lower edge of the wall of the apron 47. This results in the lower edge of the wall of the apron 47 reaching out and scooping dirt as well as cutting through the dirt as the apron 47 closes. Additionally, the concaved portion of the wall of the apron 47 compresses and pushes the additional dirt scooped out by the lower edge of the apron 47 well into the bucket behind.

Further, the pivot axis through the pivot pins 49 is transverse of the frame and located at a vertical distance above the bottom of said frame equal to at least one-half of the vertical depth of the bucket and displaced at least slightly forward of the cutting blade 33, which also aids the scooping and pushing of dirt by the apron 47 as discussed above.

The combination of the requirements as set forth for the apron results in superior performance in several respects. When the apron is opened, dirt severed from the terrain is forced backward into the bucket. As the bucket fills, dirt fills forward into the end formed by the apron. When the bucket and apron portion are filled with dirt, the apron is lowered to its closed position so that the load can be carried to its ultimate place of disposal. However, in closing, the apron must cut through the pile of dirt formed at the opening between the apron and the blade. As explained above, the apron of the present invention reaches out and engages as much of the pile as possible as a result of the placement of the pivot axis forward of the cutting blade 33 and because of a paddle-like effect achieved by the difference between the distances from the upper and lower edges of the apron and the pivot axis about which the apron pivots. The apron of the present invention in effect scoops additional dirt into the bucket. Additionally, the apron efficiently cuts its way through the side of dirt without causing undue stress or strain on the apron.

Figure 7:
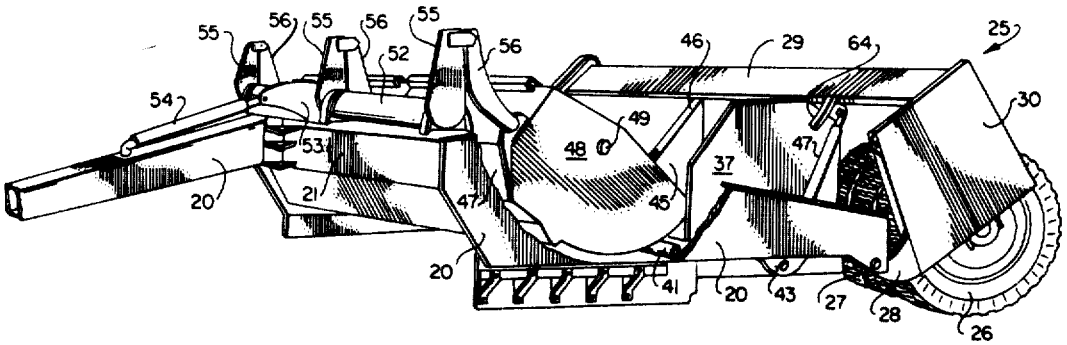
FIG. 7 is a pictorial view similar to that of FIG. 1 with a portion of the frame broken away to show the apron in its open elevated position.

The apron is moved between its open and closed position by a hydraulic ram associated with a lever linkage system. As best illustrated in FIGS. 1, 7 and 8, a drive shaft 52 of substantial cross-sectional size so as to be able to transfer large torques is mounted generally above and parallel with the front end frame member 21 for pivotal movement about the central axis through the drive shaft 52. A central bell crank 53 extends from the drive shaft 52, and a hydraulic ram 54 is pivotally connected at its respective ends to the tongue 23 and the free end of the bell crank 53. When the ram 54 is shortened, the drive shaft is pivoted as the bell crank 53 is pulled forward to the position shown in FIG. 1. When the ram 54 is lengthened, the drive shaft is pivoted in the opposite direction to where the bell crank 53 extends generally upwardly as shown in FIG. 7. Four additional bell cranks 55 are provided extending from the drive shaft 52 at a substantially 90-degree angle to bell crank 53. Two of the bell cranks 55 are at the opposite ends respectively of the drive shaft 52, with the third and sometimes a fourth as described hereinafter as being positioned closely adjacent to bell crank 53. Linkages 56 are pivotally attached at mutually respective ends to the extending ends of the bell cranks 55, with the other ends of the linkages attached to the upper portion of the upstanding wall of the apron 47. When the ram 54 is shortened, the pivoting action of the drive shaft 52 rotates the bell cranks 55 upwardly as shown in FIGS. 1 and 7, and the linkages 56 in turn pivot the apron into its open position. When the ram 54 is lengthened, the drive shaft rotates the other way and the bell cranks 55 rotate downwardly as shown in FIG. 8, and the linkages 56 push the apron to its closed position. Means are provided for accommodating the swinging up and down movement of the apron 47 relative to the blade support member 34. As will be recalled, the blade support member 34 extends along the center of the frame from the rear frame member 22 to the front frame member 21. To prevent interference between the apron 47 and the blade support member 34, an elongate open means in the form of a slot opening 58 is provided in the apron 47 extending from the top edge of the apron substantially vertically downwardly as best illustrated in FIGS. 5A and 5B. The slot opening 58 has a width sufficient to receive the forward end portion of the support member 34 so that the apron 47 can move up and down relative to the support member 34 without interference therefrom.

Figure 12:
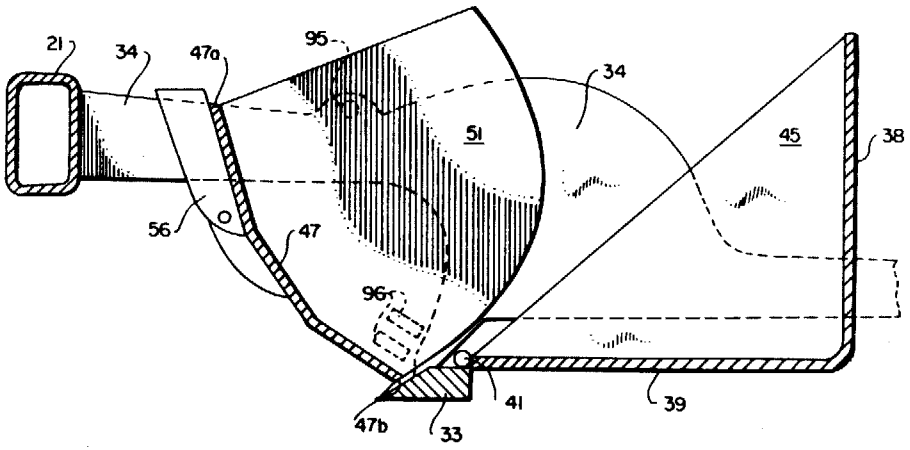
FIG. 12 is a partial cross-sectional view taken along line 12—12 of FIG. 11.
Figure 11:
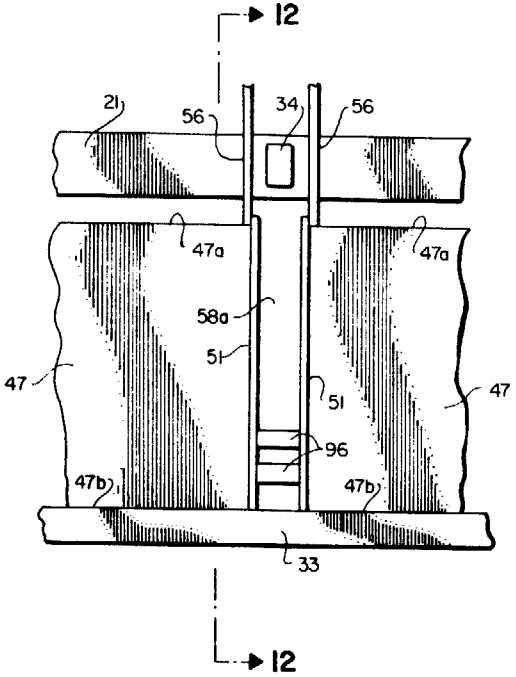
FIG. 11 is a partial cross-sectional view similar to that of FIG. 5B showing an alternative arrangement for the apron to clear the forward end portion of the central support member for the blade.

In an alternate form of the open means to allow swinging of the apron 47 relative to the blade support member 34, the slot or opening, in which the forward end portion of the support member 34 is received, extends through the entire width of the wall 47 of the apron. This is best shown in FIGS. 11 and 12. The slot opening **58*a* is seen to extend from the top edge 47*a* of the apron wall 47 to the bottom edge 47*b* thereof. As shown in FIGS. 11 and 12 the lower edge of the apron wall 47 is the closed position resting against the blade 33. The opening 58*a* through the apron wall 47 in effect achieves two apron portions. To support the inner ends of these portions, i.e., the ends formed by the opening 58*a* extending through the wall 47, parallel end plates 51 are attached as by welding edgewise to the respective edges of the opening 58*a*. The plates 51 extend backwards substantially normal to the apron wall 47 with the plates 51 being face to face but separated by the forward portion of the support member, i.e., the plates 51 are located one on each side of the support member 34. The plates 51 extend backward and are pivotally attached to a hinge pin 95 (FIG. 12) which is attached to the blade support member 34 in alignment with the hinge pins 49 about which the apron 47 pivots. Thus, the plates 51 give pivotal support to the midsection of the apron and the slot opening 58*a* is maintained through the wall 47** of the apron.

The plates 51 extend downwardly from the pivot pins to the lower edge **47*b* of the apron wall 47. Preferably the back edge of the plates are curvalinear as shown in FIG. 12 to extend slightly over the lower curved edge of the blade support member 34 when the apron is in its closed position. Cross bars 96 can be positioned between the plates 51 at their lower ends adjacent to the lower edge 42*b* of the apron wall 47 as shown in FIGS. 11 and 12. The cross bars 96 stabilize the lower portion of the apron in the vicinity of the slot 58*a*. When the apron 47 rotates to its elevated position, the cross bars 96 rotate upwardly near the forward portion of the support member 34**.

When the apron 47 is divided by a through slot **58*a* as shown in FIGS. 11 and 12, two linkages 56 extend upwardly from the respective portions of the apron. The linkages 56 are attached to two bell cranks making the total bell cranks 55 used being 4. The two linkages 56 shown in FIG. 11 are connected to two bell cranks 55 which are the third and fourth bell cranks as mentioned previously in describing the system for moving the apron 47. When a shorter slot opening 58 as shown in FIG. 5B is provided in the apron 47 only linkage 56 and one bell crank 55** is used at the center of the apron and the total bell cranks used are three.

As can be seen, the two plates 51 are positioned on the respective sides of the support member in about the same planes as the gusset members 45. Interference can be avoided by spacing the plates 51 sufficiently apart so that if the bucket is pivoted forwardly without opening the apron 47, the two plates 51 slide along the faces of the gusset members 45. However, in ordinary use, the apron is opened simultaneous with the forward tilting of the bucket and the plates 51 pivot out of the way and do not interfere with the gusset members 45 even though they may be in the same plane as the gusset members 45.

In a preferred embodiment of the invention, guard plates 60 are provided on each side of the apparatus extending upwardly from the respective side frame members 20. The guard plates 60 are positioned parallel to the respective side walls 37 of the bucket and the respective outside faces of the end walls 48 of the apron 47. The side walls 37 of the bucket and the end walls 48 of the apron 47 are adapted to make face-to-face, interleaved movement with each other as the bucket and apron are moved in their respective pivotal movements. The end walls 48 of the apron 47 are closely spaced to the outside faces of the respective side walls 37 of the bucket. Being positioned on the outside of the bucket, the end walls 48 of the apron 47 can move without tending to force dirt and rocks between the end walls 48 of the apron 47 and the respective side walls 37 of the bucket. The bucket can also pivot forward completely within the apron without interference between the sides of the apron and the bucket. When the apron 47 of the present invention closes, the end walls 48 of the apron slide along the outside of the side walls 37 of the bucket and do not engage the dirt on the inside of the bucket. In apparatus of the prior art, the apron sides move inside the bucket and as such cut through or otherwise contact the dirt on the inside of the bucket, and as a result, dirt and rocks tend to become entrapped between the sides of the apron and the side walls of the bucket which increases greatly the wear on the apparatus and can cause periodic breakdowns by excessive binding between the apron and the bucket.

Preferably, the trailing edge of the end walls 48 of the apron 47 have an arcuate shape with a radius from the pivot axis 49 of the apron 47 the same as the distance from the pivot axis 49 of the apron 47 to the cutting blade 33. Thus, when the apron opens, the arcuate portions of the respective end walls 48 swing so that the perimeters of the arcuate portions are always adjacent to the respective ends of the cutting blade 33. This prevents dirt from being pushed out beyond the ends of the cutting blade 33 when the blade is cutting through the ground. Without the arcuate trailing edge of the end walls 48 being adjacent to the end of the cutting blade 33, dirt is pushed around the ends of the blade 33 and forms a long ridge of dirt like a windrow along the edge paths of the cutting apparatus. The trailing edges of the walls 48 act to contain the dirt and prevent such windrow-like ridges.

The guard plates 60 extend upwardly along the outside of both the end walls 48 of the apron and the side walls 37 of the bucket as shown in FIG. 1A, with the end walls 48 of the apron interleaved between the side walls 37 of the bucket and the guard plates 60. The guard plates 60 prevent dirt from falling from the generally V-shaped depression which is formed by the apron walls 48 and the side walls of the bucket as the apron is opened and the bucket simultaneously tilted into its elevated dumping position.

Figure 6:
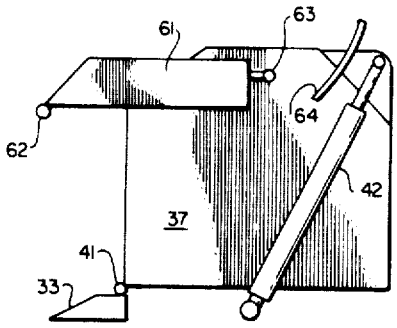
FIG. 6 is a schematic plan view of the end wall of the bucket showing the location of the hydraulic ram for lifting the bucket and also showing schematically the dirt shield and the striker means on the bucket for lifting the dirt shield upwardly as the bucket is pivoted forwardly.

To prevent unwanted dirt from falling onto the top of the side frame members 20 and the pivotal connections of the hydraulic rams 32 which operate with the carriage 25 to raise and lower the frame relative to the terrain, a pair of dirt shields 61 are pivotally mounted to the respective stationary guard plates 60. As shown in the drawings, the dirt shields 61 form an elongated hood-shaped shield which covers the portion of the top of the side frame members 20 where the rams 32 are connected to the side frame members 20. The dirt shields 61 are mounted to the stationary guard plates 60 at the forward end of the dirt shields 60 about a pivot pin 62 which is received in a cylindrical journal bearing on the dirt shields 61. Means are provided for tilting the dirt shields forwardly when the bucket is moved into its forwardly tilted dumping position. The pivotal movement of the dirt shields 61 is required so as to move the dirt shields 61 from the paths of the respective rams 42 which operate the bucket. The means for tilting the dirt shields 61 comprises striker bars 63 positioned on the trailing end of the dirt shields 61. A striker plate 64 is provided on each of the side corners of the bucket extending outwardly from the side walls 37 of the bucket. The striker plates 64 extend generally vertically up along the top end of the respective rams 42 which are connected to the upper corners of the bucket. The striker plates 64 are slanted slightly towards the back of the bucket as shown and are also shaped so as to be slightly concave as shown in FIG. 6. The striker plates 64 are adapted to engage the dirt shields 61 and push the dirt shields 61 into their forwardly tilting positions when the bucket is moved into its elevated dumping position.

Improved hitch means are also provided for connecting the tongue 23 of the apparatus to a motive vehicle such as a tractor. The apparatus of the invention carries a heavy load and thus the hitch means must be designed to withstand a very large pulling force from the motive vehicle. In accordance with the invention, there is provided a heavy duty hitch means which also provides for pivotal movement about a substantially vertical axis between the tongue 23 and the motive vehicle for turning of the motive vehicle and the apparatus. Also provided is a pivotal movement about a substantially horizontal axis transverse of the motive vehicle to accommodate up and down movements of the motive vehicle and the apparatus. Further, there is provided a pivotal movement about a substantially horizontal axis which is parallel to the longitudinal center of the apparatus to accommodate rocking of the apparatus over very unstable terrain. Further the improved hitch means provides for an adjustment of the hitch pin up and down to match the height of the hitch means on the motive vehicle.

Figure 9:
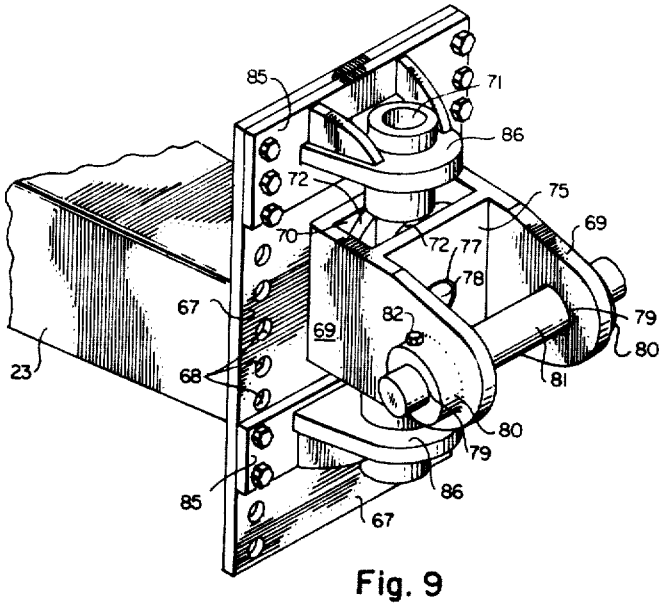
FIG. 9 is a pictorial of the end of the tongue of the apparatus showing hitch means by which the apparatus is attached to a motive vehicle.
Figure 10:
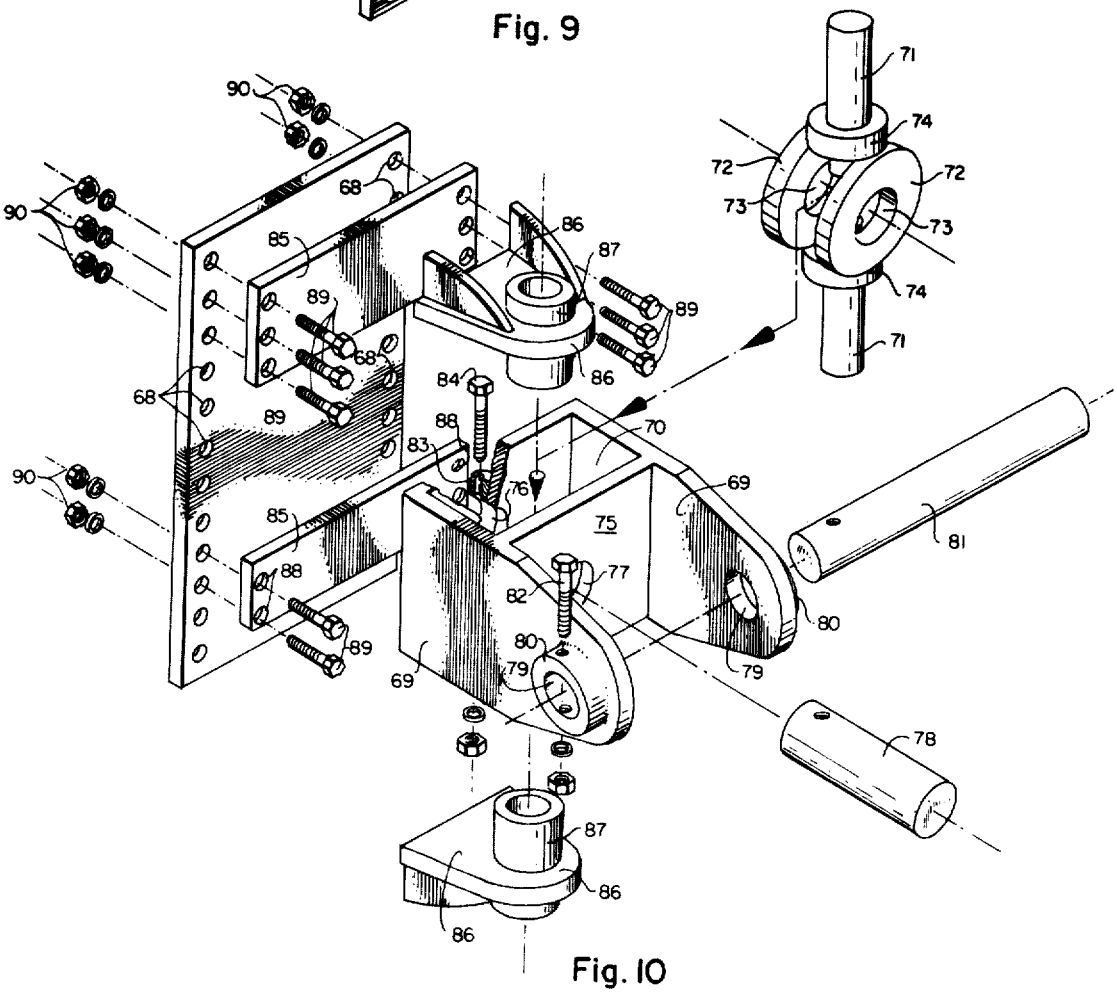
FIG. 10 is an exploded view of the hitch means of FIG. 9.

The hitch means as best illustrated in FIGS. 9 and 10 comprises a substantially flat mounting plate 67 which is attached as by welding to the forward end of the tongue 23. A plurality of equally spaced holes 68 are provided along the vertical sides of the plate 67. A yoke in the form of two spaced apart side plates 69 which are attached together by a base plate 70 at mutually respective ends of the side plates 69 is held in place by a vertically disposed pin and retainer means and upper and lower brackets which are adjustably attached to the mounting plate 67 and adapted to engage the pin and retainer means.

As shown, the vertically disposed pin and retainer means comprises two pin members 71 which are disposed in spaced apart alignment along their longitudinal center lines. The pins 71, of course, have the same diameter. Two parallel discs 72 are welded to the adjacent ends of the pins 71 and retain the pins 71 in their spaced relationship. The discs 72 are also aligned with each other and have circular outer shapes with the same diameter. Central, aligned circular holes 73 are provided in the discs 72 so that a cylindrical opening is provided through the holes 73 and the space between the pins 71. Two collars 74 are welded in place about the pins 71 with the collars 74 also abutting and being welded to the respective discs 72 at their points of contact.

The pin and retainer means is disposed between the side plates 69 of the yoke, with one of the discs 72 abutting flatwise the inside face of the base plate 70 of the yoke. A frontal plate 75 is attached between the side plates 69 of the yoke with the respective sides of the frontal plate 75 being welded firmly to each side plate 69. The frontal plate 75 is spaced from the base plate 70 so that when the pin and retainer means is positioned in place abutting base plate 70, the other disc 72 abuts flatwise the inside face of the frontal plate 75. The base plate 70 and the frontal plate 75 are substantially square in shape, with the sides of the frontal plate 75 being just slightly larger than the diameter of the discs 72.

Central holes 76 and 77 are provided in the base plate 70 and frontal plate 75, respectively. The holes 76 and 77 are in alignment with each other and adapted to align with the holes 73 in the discs 72 when the pin and retainer means are positioned in the yoke. A cylindrical pin 78 is received through the aligned openings or holes 76, 77 and 73 to pivotally hold the pin and retainer means in place in the yoke. As can be seen, the yoke is thus adapted to pivot about the pin 78 relative to the pins 71 of the pin and retainer means.

The free, extending ends of the side plates 69 of the yoke have holes 79 which are aligned with each other. Reinforcement collars 80 are welded to the plates 69 around the holes 79. A hitch pin 81 is adapted to extend through and between the holes 79 and collars 80. A set screw 82 can be provided to work in combination with a threaded bore in one of the collars 80 to maintain the hitch pin 81 in place. The hitch pin 81 is, of course, adapted to be connected to the clamp or draw bar means of the motive vehicle. The set screw 82 can alternatively be adapted to extend through aligned bores in the collar 80 and pin 81, with a nut being attached to the other end of the set screw which extends from the collar 80. A similar set screw mechanism can be used to retain the pin 78 in place in the yoke. A collar 83 is provided on the outer face of the base plate 70 with a set screw 84 similar to set screw 82.

The yoke 69 and the associated pins 71 and discs 72 are attached to the mounting plate 67 by an upper and lower bracket means. Each of the bracket means comprise a substantially flat base plate 85 having a lug or ear 86 extending outwardly therefrom. A journal bearing 87 is affixed to an opening through the lug or ear 86, with the axis of the journal bearing 87 being substantially normal to the lug or ear 86. The upper and lower brackets are adapted to be attached to the mounting plate 67 of the hitch so that the respective journal bearings 87 receive the upper and lower extending otherwise free ends of the pins 71.

As shown, the base plates 85 of the upper and lower brackets have a plurality of equally spaced holes 88 in the opposite sides thereof. The holes 88 are adapted to register with equally spaced holes 68 in the mounting plate and bolts 89 and nuts 90 hold the base plates firmly in place. The base plates 85 of the brackets can be moved up or down on the mounting plate so as to give vertical adjustment of the hitch means relative to the tongue 23 of the scraper apparatus.

The hitch means provides pivoted movement about the substantially vertically disposed pins 71 to accommodate turning of the motive vehicle as it pulls the scraper apparatus. In additon, the hitch provides a rolling pivot through the substantially horizontally disposed pin 78 to accommodate rocking motion relative to the scraper apparatus and the motive vehicle as the apparatus is pulled over uneven terrain. The hitch pin 81, of course, allows pivotal movement of the tongue 23 through an axis transverse of the motive vehicle for up and down movement of the scraper relative to the motive vehicle.

While incorporating a horizontal pin 78 which is in alignment with the centerline of the motive vehicle and scraper apparatus, the hitch does not rely on the strength of the set screw 84 associated with the pin 78 for transmitting, pulling and pushing forces from the motive vehicle to the scraper apparatus. The discs 72 which are attached to the pins 71 cooperate with the base plate 70 and the frontal plate 75 of the yoke to transmit the forces from the yoke to the pins 71 rather than relying on transmittal of the forces through the pin 78 and its set screw 84. The plates 72 having circular perimeters are adapted to pivot about the pin 78 within the confines of the base plate 70, frontal plate 75 and side plates 69 of the yoke.

Although a preferred embodiment of the invention has been illustrated and described, it is to be understood that various variations are possible without departing from the subject matter coming within the scope of the following claims, which subject matter is regarded as the invention.

I claim:

1. In an earth-moving, ground leveling and land planing machine having a frame supported by at least two ground engaging wheels at the back end of the frame; a cutting blade disposed laterally between the opposite, longitudinal sides of said frame and adjacent to the bottom of said frame, with the blade positioned so that at least the forward cutting edge thereof is disposed below the bottom of said frame; and a bucket having a floor and upstanding back and side walls, said bucket being disposed with the forward edge of said floor thereof adjacent to the trailing edge of said blade; and a vertically movable apron forming an operable front wall for said bucket, an improvement in said machine wherein:

the apron comprises a swingable gate including a substantially upstanding wall extending transversely of the frame, said upstanding wall being generally concave in shape for strengthening said wall and for aiding the lower edge of said wall to cut through the dirt as the apron is lowered into its closed position said apron further having end walls extending back parallel to and spaced from the outer faces of the side walls of said bucket, with the trailing edge of the end walls of said apron having an arcuate shape with a radius from the pivot axis of said apron about the same as the distance from said pivot axis of said apron to the cutting blade;

means are provided for swinging the apron about a pivot axis which is transverse of the frame, at a vertical distance above the bottom of said frame equal to at least one-half the vertical depth of said bucket and displaced forward of said bucket, whereby when said apron opens, the arcuate portions of the respective end walls swing so that the perimeters of the arcuate portions are always adjacent to the respective ends of the cutting blade; and said bucket is adapted to pivot about an axis through the forward edge of said floor thereof from a lowered carrying position in which said floor is substantially horizontal to an elevated dumping position in which said floor is in a forwardly tilted position and vice versa.

2. The improvement as claimed in claim 1, wherein a pair of stationary guard plates extend upwardly from the respective sides of the frame so as to be positioned parallel to the respective side walls of said bucket and the respective sides of the end walls of the apron.

3. The improvement as claimed in claim 2, wherein:

a pair of dirt shields are pivotally mounted, respectively, to the frame through a pivot axis at the forward end of said dirt shields so that the dirt shields can pivot upwardly from a rest position in which the dirt shields extend substantially longitudinally above the outside top edges of the stationary guards to an elevated position in which the dirt shields extend longitudinally upwardly from their respective pivot axes; and striker guide means are provided on the side corners of said bucket which are adapted to engage the rearward ends of said dirt shields and push the dirt shields into their elevated positions when said bucket is pivoted into its forwardly tilting position.

4. The improvement as claimed in claim 1, wherein:

said bucket is adapted to pivot about an axis through the forward edge of said floor thereof from a lowered carrying position in which said floor is substantially horizontal to an elevated dumping position in which said floor is in a forwardly tilted position and vice versa, and means are provided for pivoting the bucket comprising:

at least one hydraulic ram pivotally attached at one end thereof to the frame near the bottom of said frame at a point along the longitudinal length of the frame which is between about the midpoint and the back edge of the floor of said bucket when said bucket is in the lowered carrying position; and means pivotally connecting the other end of said hydraulic ram to said bucket near the back upper edge corner thereof, whereby the hydraulic ram lifts and pivots the bucket with minimal shear forces exerted at the axis about which the bucket pivots.

5. The improvement as claimed in claim 4, wherein two hydraulic rams are provided, one at each side of the frame.

* * * * *